United States Patent [19]

Enomoto

[11] 4,155,317

[45] May 22, 1979

[54] MACHINE FOR SEWING TOGETHER FABRIC PIECES

[75] Inventor: Fumitake Enomoto, Sagamiko, Japan

[73] Assignee: France Bed Co., Ltd., Tokyo, Japan

[21] Appl. No.: 822,515

[22] Filed: Aug. 8, 1977

[30] Foreign Application Priority Data

Nov. 19, 1976 [JP] Japan ..... 51/154509
Nov. 24, 1976 [JP] Japan ..... 51/140916

[51] Int. Cl.[2] ..... D05B 11/00

[52] U.S. Cl. ..... 112/3 R; 112/121.26; 112/139; 112/148; 112/318

[58] Field of Search ..... 112/262, 3 R, 3 A, 2, 112/121.26, 10, 139, 148, 153, 136, 211, 214

[56] References Cited

U.S. PATENT DOCUMENTS 1,784,614 12/1930 Sailer ..... 112/139
2,667,132 1/1954 Golden ..... 112/10
2,915,027 12/1959 Smith ..... 112/3 R
3,160,124 12/1964 Cash, Jr. ..... 112/139 X

*Primary Examiner*—H. Hampton Hunter
*Attorney, Agent, or Firm*—Flynn & Frishauf

[57] ABSTRACT

A method for sewing together fabric pieces which comprises the steps of sewing elastic cord-like core material such as polyethylene cord along the edge portions of two or more fabric pieces, automatically engaging the edge portions of the fabric pieces with each other by guiding the sewn core material, and sewing together the engaged edge portions to render an assembly of fabric pieces adapted for use as a cover; and a machine for sewing together fabric pieces which is provided with a core material-guiding mechanism for clamping core materials previously sewn to the edge portions of two or more fabric pieces being sewn together, thereby engaging the edge portions with each other.

11 Claims, 9 Drawing Figures

MACHINE FOR SEWING TOGETHER FABRIC PIECES

BACKGROUND OF THE INVENTION

This invention relates to a machine for sewing together fabric pieces.

The known method for sewing together two or more fabric pieces generally comprises the steps of manually engaging the edge portions of fabric pieces, sewing together the fabric pieces and stationary sewing machine while manually pushing the engaged edge portions of fabric pieces toward the stationary sewing machine; or manually holding the engaged portions of fabric pieces in front of sewing machine moving around a work table, thereby sewing together the edge portions. The prior art machines for sewing up, for example, a cushion cover based on the concept of the above-mentioned fabric-sewing method include the U.S. Pat. No. 3,641,954 issued on Feb. 25, 1972 to Kalning et al, the U.S. Pat. No. 3,664,280 issued on May 23, 1972 to Redman et al and the U.S. Pat. No. 4,014,274 issued on Mar. 29. 1977 to Kosakai (Assignee: France Bed Ltd.). With these conventional sewing machines, an operator personally engages the edge portions of fabric pieces and sews up an assembly of fabric pieces on a movable sewing machine while holding the engaged edge portions of the fabric pieces. In this case, it may be contemplated to use marking pins in order to prevent the manually engaged edge portions of fabric pieces from being separated. Obviously, these marking pins have to be manually fixed. Even where the sewing of fabric is undertaken by the known machine provided with a shifting mechanism bearing a saw-toothed slider designed to carry fabric rearward of a sewing machine by contacting the underside of fabric, an operator still has to engage the edge portions of fabric pieces by hand. Therefore, the operator should always attend to a sewing machine, failing to operate a plurality of sewing machines at the same time. The customary sewing method which causes the edge portions of fabric pieces to be manually engaged demands an operator to have an advanced skill, presenting difficulties in providing, for example, a cushion cover of uniform quality and making it practically impossible to automate the operation of the sewing machine and save labor.

SUMMARY OF THE INVENTION

This invention has been accomplished in view of the drawbacks of the prior art sewing method and is intended to provide a machine for automatically sewing together fabric pieces by engaging the edge portions of fabric pieces mechanically instead of manually as has been practiced in the past.

In the present invention, an elastic cord-like core material prepared from plastics, for example, polyethylene is previously sewn to the edge portions of fabric pieces being sewn together. The cord-like core material is guided by a core material-guiding mechanism which is fitted with a pair of clamping devices provided with mutually facing protruding guide members and vertically spaced from each other, thereby automatically engaging the edge portions of fabric pieces and later sewing together the engaged edge portions.

The present invention automates the engagement of edge portions of fabric pieces which has hitherto been manually undertaken by an operator, and consequently makes the operator only responsible for the setting of fabric pieces on a sewing machine and the removal therefrom of a sewn article, thereby almost fully automating the actual sewing work. Therefore, the present invention enables sewn articles of uniform quality to be easily manufactured in quantities without demanding an operator to have a great skill. In this case, it is preferred to clamp the edge portions of sewn fabric pieces to which a cord-like core material is already sewn by a pulling mechanism provided with a pair of simultaneously revolving rollers and disposed behind a sewing machine to sew together the edge portions while a pulling force is applied thereto, because an effective sewing work can be undertaken due to a full tension being applied to the engaged edge portions of fabric pieces to which the cord-like core material is already sewn.

A sewing machine according to this invention comprises a core-guiding mechanism positioned ahead of a sewing device to guide the cord-like core material previously sewn to the edge portions of two or more fabric pieces being sewn together for engagement of the edge portions. In this case, the sewing machine is preferred further to comprise a pulling device which is positioned behind the sewing device and is provided with a pair of horizontal rollers designed to pull the edge portions of fabric pieces to which the core material is already sewn for engagement thereof by simultaneously revolving with the edge portions clamped therebetween.

The above and further objects and novel features of the invention will more fully appear from the following detailed description when the same is read in connection with the accompanying drawings. It is to be expressly understood, however, that the drawings are for purpose of illustration only and are not intended as a definition of the limits of the invention.

DETAILED DESCRIPTION OF THE PREFERRED EMBODIMENT

There will now be described by reference to the accompanying drawings of fabric-sewing machine embodying this invention. For convenience, description is given of the sewing of, for example, a cushion cover.

A mattress comprises, as is well known, an interior cushion and a cover enclosing the cushion. A cushion cover comprises a pair of sheets laid on the top and bottom surface of a cushion and gusset connected to the paired sheets to form a cushion over into a three-dimensional body. Where the upper and lower sheets and gusset we used to enclose a cushion, one of the paired sheets is first sewn to the gusset to provide a bag open on one side. After a cushion is received in the open bag, the other sheet is laid on the upper surface of the cushion and later sewn to the gusset. In this case, the cushion cover has to enclose the whole cushion without sagging. To this end, therefore, the upper and lower sheets and gusset are so cut that when enclosing the cushion, they provide a slightly smaller volume than the cushion. With the conventional sewing method, therefore, the final sewing of the cushion cover is effected by sewing together the upper and lower sheets and gusset with the cushion forcefully compressed by the operator's elbow.

Figure 1:
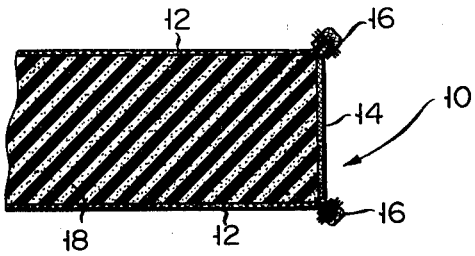
FIG. 1 PRIOR ART
FIG. 1 is a fractional sectional view of the conventional mattress.

As shown in FIG. 1, the upper and lower sheets 12 and gusset 14 of the known mattress 10 are sewn together with the sewn edge portions thereof covered with a cloth tape 16 without losing the outer appearance of the mattress as a whole. With the prior art mattress 10, an operator manually engages the edge portions of the upper and lower sheets 12 and gusset 14 by compressing a cushion 18 by the elbow and sews together the engaged edge portions and the automatically supplied cloth tape 16 by a sewing machine. However, the customary cushion cover-sewing method has the drawback that since the edge portions of the upper and lower sheets 12 and gusset 14 are sewn together with the cushion 18 forcefully compressed by the physical force of an operator, the operator is ready to be fatigued. In view of the abovementioned difficulties, there have been proposed the U.S. Pat. Nos. 3,641,954; 3,664,280 and 4,014,274 which are designed alike mechanically to sew together the edge portions of a cushion cover with a cushion mechanically compressed. With these patents, however, the edge portions of upper and lower sheets 12 and gusset 14 are supplied to a sewing machine still in the manually engaged form, thus making little contribution to the automatic operation of a fabricsewing machine and labor saving.

Figure 2:
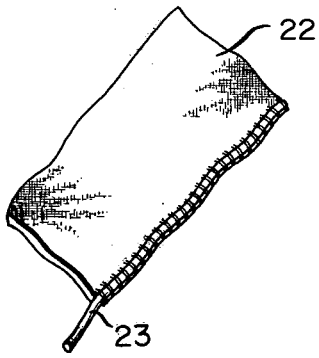
FIG. 2 is a fractional perspective view of an upper sheet of a cushion cover used in the sewing method of this invention.

According to a fabric-sewing method embodying this invention, a cord-like core material 23 is first sewn, as shown in FIG. 2, the edge portions of upper and lower sheets 12 and gusset 14 constituting a cushion cover. The core material 23 is formed of an elastic material which can present the same curvature as the edge portions of the upper and lower sheets 12 and gusset 14 position in the cushion corners. The core material 23 is preferred to be formed of a cord of plastics material, for example, polyethylene rather than a metal cord, in consideration of water-proofness and resistance to thermal expansion. Further, if formed with a substantially circular cross section, the core material 23 can be easily grasped due to freedom from directionality. The core material 23 can be automatically sewn to the edge portions of the upper and lower sheets 12 and gusset 14 by three threads, for example, on the known lock type sewing machine.

Figure 3:
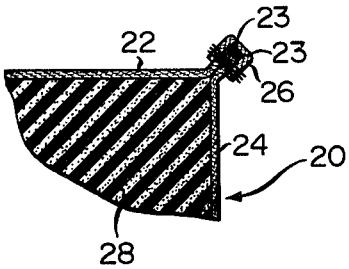
FIG. 3 is a fractional sectional view of a mattress manufactured by the fabric-sewing machine of the invention.

The upper and lower sheets 22 and gusset 24 whose edge portions are already fitted with the core material 23 are sewn together by a sewing machine comprising a core material-guiding mechanism which is set just ahead of the sewing position and designed to grasp the core materials 23 sewn to the edge portions of the upper and lower sheets 22 and gusset 24 for mutual engagement of the core materials 23. As the result, a mattress 20 is provided in the form shown in FIG. 3 At this time the edge portions of the upper and lower sheets 22 and gusset 24 already fitted with the cordlike core material 23 are sewn together in the state surrounded by a cloth tape 26. Referential numeral 28 denotes a cushion.

As mentioned above, the fabric-sewing method of this invention causes a cord-like core material 23 to be previously sewn to the edge portions of, for example, the upper and lower sheets 22 and gusset 24 of a cushion cover. Therefore, the edge portions can be securely engaged with each other with the cushion 28 properly compressed by fastening together the cord-like core materials 23 already sewn to the edge portions. Therefore, the fabric-sewing method of the invention enables a cushion cover to be sewn up with a uniform quality without demanding an operator to have an advanced skill and a great physical force. According to this invention, other operations than the setting of a cushion on a work table and its removal therefrom (including the final sewing of a cushion cover fully to seal a cushion therein) are automated. If, therefore, a sewing machine is made automatically to stop after the substantial sewing up of a cushion cover by means of, for example, a microswitch, then a single operator can operate a large number of sewing machines, thereby attaining not only considerable labor saving but also the quantity production of mattresses.

Where a cushion cover is initially sewn up in the form of a bag open on one side to receive a cushion, the sewing can be automatically carried out if a cord-like core material is previously sewn to the edge portions of the upper and lower sheets 22 and gusset 24 constituting a cushion cover.

There will now be described by reference to FIGS. 4 and 5 the arrangement and operation of a fabric-sewing machine embodying this invention. A sewing machine 30 comprises a bed 31 fixed to the floor surface, a movable table 32 mounted on the bed 31, a sewing device 33 for sewing together two fabric pieces, for example, an upper or lower sheet 22 and gusset 24 whose edge portions are already fitted with a cord-like core material (not shown), a core material-guiding mechanism 34 positioned ahead of the sewing device 33 and designed to gasp the core materials for automatic engagement, and a pulling device 35 disposed behind the sewing device 33 to pull the edge portions of the sheet 22 and gusset 24 being sewn together.

The movable table 32 is provided with a plurality of spherical casters 37 capable of moving lengthwise and crosswise through a groove 36 formed in the upper surface of the bed 31. A cantilever bag holder 38 is bolted to a table 32. FIGS. 4 and 5 represent the case where a lower sheet 22 and gusset 24 are sewn together to provide an open cover for receiving a cushion. Where the other or upper sheet 22 is sewn to the gusset 24 after receiving the cushion in the open cover to finish a mattress, then the cantilever bag holder 38 is taken off to cause a mattress being finished to be directly set on the table 32.

The sewing device 33 comprises a sewing body 40 for sewing together the upper and lower sheets 22 and gusset 24, and a carrier 41 designed to move about the bed 31 while holding the body 40. The carrier 41 is formed of an upper carrier section **41*a* to which the body 40 fis fitted and a lower carrier section 41*b* to which the upper carrier section 41*a* is fixed. The lateral side of the lower carrier section 41 *b* is provided with a wheel 43 rolling through a guide groove 42 formed in the upper surface of a projection of the bed 31. The table 32 is provided with a carrier-guiding rail 44. An outer roller 45 fitted to the upper carrier section 41*a* by means of an arm and an inner roller 46 fitted to the lower carrier section 41*b* by means of an arm are pressed against both sides of the guide rail 44**.

Figure 6:
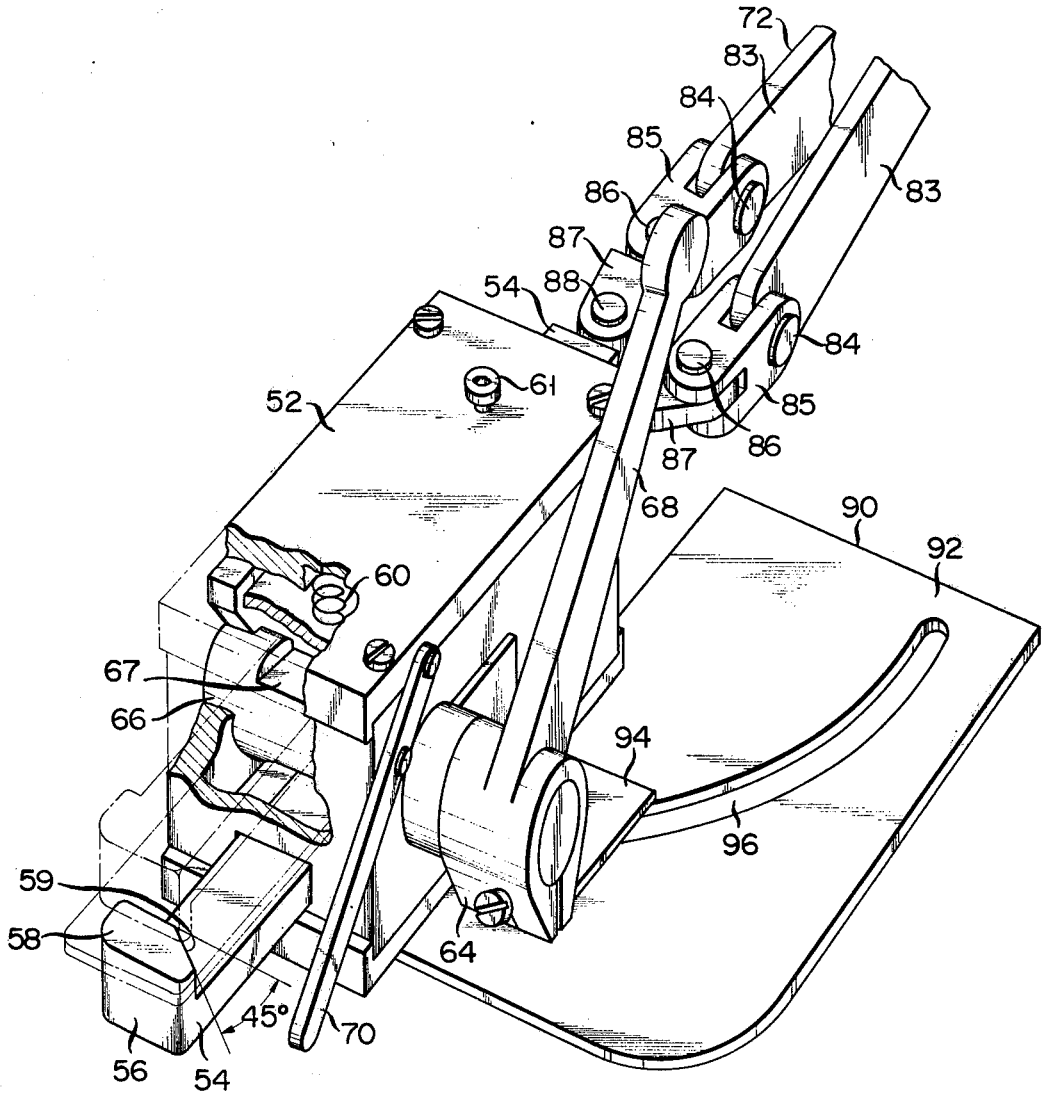
FIG. 6 is a perspective view of a core material-guiding mechanism.
Figure 7:
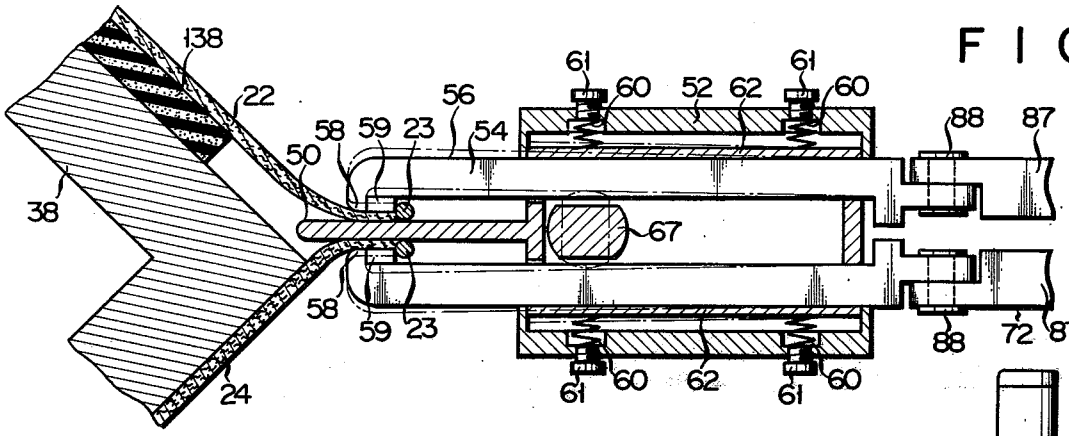
FIG. 7 is a longitudinal sectional view of the core material-guiding mechanism.

As shown in greater detail in FIGS. 6 and 7, the core material-guiding mechanism 34 comprises a housing 52 integrally fitted with a central projecting board 50 (FIG. 7) and a clamping device 56 provided with a pair of clamping members 54 projecting through the housing to clamp the core materials 23 sewn to the edge portions of the upper and lower sheets 22 and gusset 24 between the housing 52 and central projecting board 50. The paired clamping members 54 comprises mutually facing guide attachments 58 so projecting as to guide the insertion of the core material 23. The guide surface 59 of the projecting guide attachment 58 is preferred, as shown in FIG. 6, to be inclined at an angle of about 45° so as to smoothly guide the insertion of the core material 23. Two upper compression coil springs 60 and two lower compression coil springs 60 are provided, as shown in FIG. 7, between the vertically spaced clamping members 54 and the upper and lower inner walls of the housing 52 so as to push the clamping members 54 toward the central projecting board 50. The two sets of the compression coil springs 60 are pressed against the corresponding support boards 62 to be saved from distortion when the paired clamping members 54 slide through the housing 52. The support boards 62 are so fitted to the inner walls of the housing 52 as to move vertically but not crosswise. If, for example, hexagonal socket head bolts 61 whose innermost ends abut against the corresponding compression coil springs 60 are provided on the outer wall of the housing 52 so as to admit of changes in the biasing force of the springs 60, then the clamping members 54 can be desirably set in the optimum position to meet the material and thickness of fabric pieces being sewn together.

The core material-guiding mechanism 34 comprises cam means 64 (FIG. 6) designed to separate the clamping members 54 from each other against the biasing force of the compression coil springs 60 and provide a larger space than the diameter of the core material 23 between the clamping members 54 and central projecting board 50, thereby facilitating the insertion of the core materials 23 into the guiding mechanism 34 and its removal therefrom. The cam means 64 comprises a horizontal shaft 66 movable supported on the housing 52 and an actuating handle 68 fixed to that end of said horizontal shaft 66 which projects out of the housing 52. The central portion of the horizontal shaft 66 is partly planed, as seen from FIG. 6a, to form a cam 67. Where, therefore, the handle 68 is turned to press the larger diameter section of the cam 67 against the clamping members 54, then these clamping members 54 are more removed from each other against the biasing force of the compression coil springs 60, thereby allowing the core materials 23 to enter between the clamping members 54 and central projecting board 50. Later when the handle 68 is turned to provide the normal condition in which the small diameter section of the cam 67 faces the clamping members 54, then the clamping members 54 are pushed toward the central projecting board 50 by the force of the compression coil springs 60, thereby causing the core materials 23 sewn to the edge portions of the uupper and lower sheets 22 and gusset 24 of the cushion cover to be securely clamped between the clamping members 54 and central projecting board 50.

The opposite side of the housing 52 to the sewing machine 33 is fitted with a downward extending guide arm 70. This guide arm 70 engages the edge portions of the gusset 24 by being brought thereinto, thereby assisting the smooth insertion between the clamping members 54 of those portions of the gusset 24 which occupy a lower position.

Reciprocation of the clamping members 54 through the housing 52 causes the edge portions of the upper and lower sheets 22 and gusset 24 to be repeatedly tensioned and sagged, thereby attaining the smooth insertion between the clamping members 54 of the core materials 23 sewn to said edge portions. To this end, therefore, the core material-guiding mechanism 34 further comprises coupling means 72 (FIG. 6) for converting a rotation moment supplied from a power source into a reciprocation moment and transmitting the reciprocation moment to the clamping members 54. As shown in FIG. 4, the coupling means 72 comprises a clutch 74, an output shaft 75 of the clutch 74, an eccentric pivot pin 76 eccentrically fitted to a disc attached to the forward end of the output shaft 75, a coupling rod 77, one end of which is connected to the eccentric pivot pin 76, an L-shaped fitting board 78 attached to the upper carrier section 41a, a coupling shaft 79 movably supported on the L-shaped fitting board 78, and a first coupling board 81, one end of which is fixed to the coupling shaft 79 and the other end of which is connected to the coupling rod 77 by means of a pivot pin 80. A second coupling board 82 is fixed to the coupling shaft 79. A pair of third coupling boards 83 (FIG. 6) are connected at one end to the second coupling board 82 by means of the corresponding pivot pins 84. The third paired coupling boards 83 occupy a vertical position. A pair of fourth vertical coupling boards 85 are connected to said third paired coupling boards 83 by the corresponding horizontal pivot pins 84. The fourth paired coupling boards 85 are connected to a pair of fifth horizontal coupling boards 86 by the corresponding vertical pivot pins 86 (FIG. 6). The paired clamping members 54 are connected to a pair of horizontal coupling boards 87 by the corresponding vertical pivot pins 88 (FIG. 7).

Figure 4:
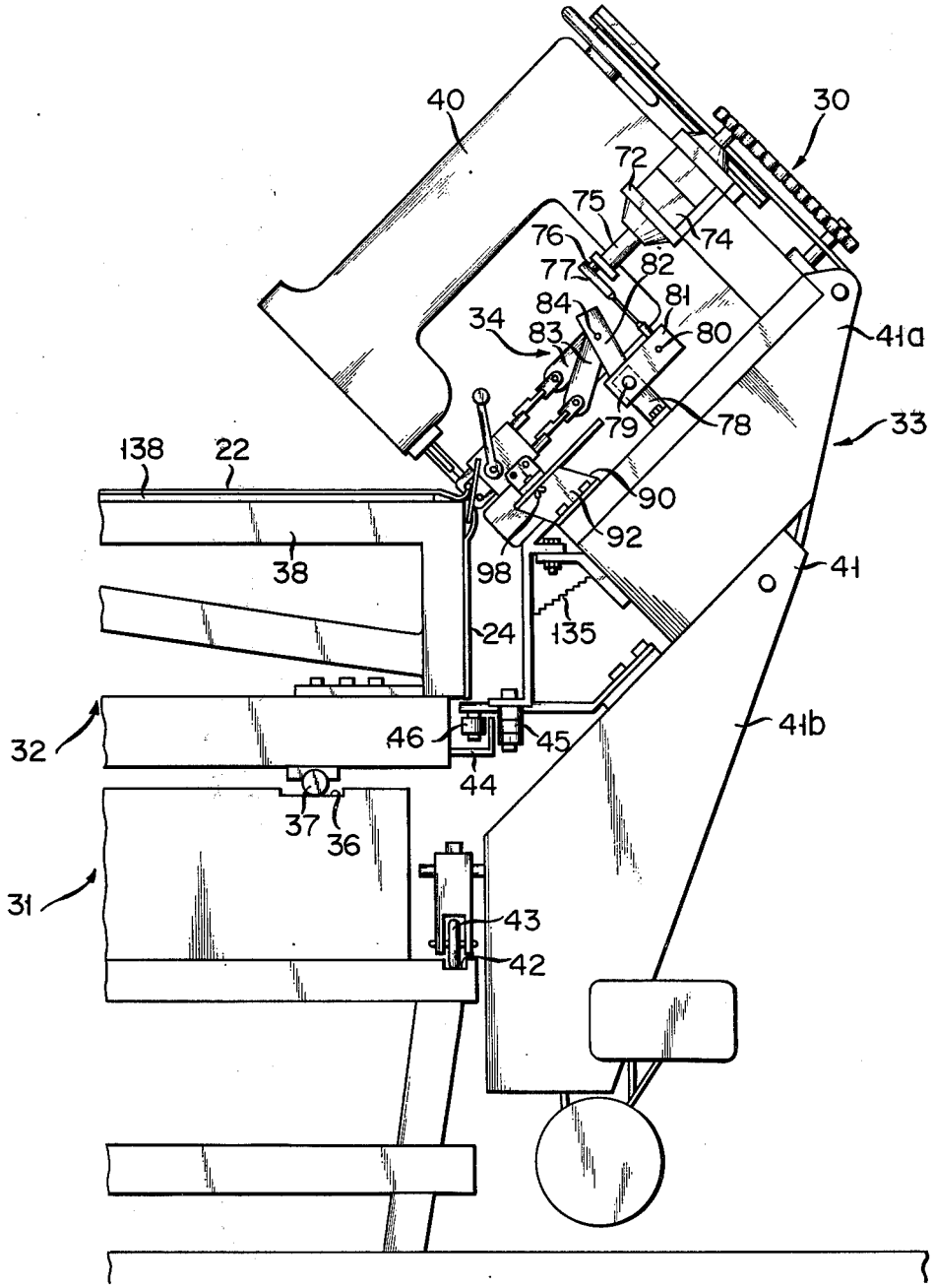
FIG. 4 is a fractional front view of a fabric-sewing machine embodying this invention.

Where, therefore, the clutch 74 takes a connecting position, the rotation moment of the output shaft 75 is transmitted to the first coupling board 81 for its rotation about the coupling shaft 79 by means of the coupling rod 77 which is connected to the clutch 74 by the eccentric pivot pin 76 (FIG. 4). The coupling shaft 79 movable supported on the L-shaped fitting board 78 rotates with the coupling board 81, thus leading to the rotation of the second coupling board 82 fixed to the coupling shaft 79. Accordingly, the pivot pin 84 of the second coupling board 82 arcuately moves about the coupling shaft 79. This arcuate movement of the pivot pin 84 is transmitted to the clamping member 54 for reciprocation.

As seen from FIG. 7, the peripheral surface of each clamping member 54 slides in abutment against the fixed board 62. The projecting guide member 58 pulls the core material 23 inward by sliding along the engaged edge portions of the upper or lower sheet 22 and gusset 24. The core material-guiding mechanism 34 comprised lock means (FIGS. 4 and 6) for setting the housing 52 supporting the clamping members 54 in a prescribed position. The lock means comprises a channel-shaped fitting board 92, one side of which is fixed to the surface of the upper carrier section **41*a* and an L-shaped board 94, one side of which is fixed to the lateral wall of the housing 52 and the other side of which occupies a parallel position with the upper surface of the channelshapped fitting board 92. With a bag sewn up all along the sides such as a cushion cover, the starting and finishing points of sewing substantially coincide. Just before the end point of sewing, therefore, the core material-guiding mechanism has to stop the clamping of the core material to release it, thus making it necessary to cause the housing 52 to retreat linearly or rotatingly. With the embodiment of this invention, the channel-shaped fitting board 92 is bored with an elongate arcuate hole 96 (FIG. 6), whose radius of curvature is centered at the vertical pivot pin 86 in order to cause the housing 52 to retreat rotatingly. A wing bolt 98 (FIG. 4) is threadedly inserted into the internal threads of the L-shaped board 94. Accordingly, the core material-guiding mechanism 34 is generally fixed in a clamping position by the wing bolt 98. Where sewing is undertaken at the end point, the wing bolt 98 is loosened to slide along the elongate arcuate hole 96 about the vertical pivot pin 86 and rotatingly retreat and later is tightened again. At this time, the finishing sewing is carried out by the sewing machine. Since another vertical pivot pin 88 is provided in addition to the above-mentioned vertical pivot pin 86, the curvature radius of the elongate arcuate hole 96 need not be centered at the vertical pivot pin 86. But it is possible to enlarge the curvature radius by shifting the other vertical pivot pin 88 in a direction opposite to that in which the housing 52 is rotated. Further, the housing 52 may be rotated about the other vertical pivot pin 88**.

Figure 9:
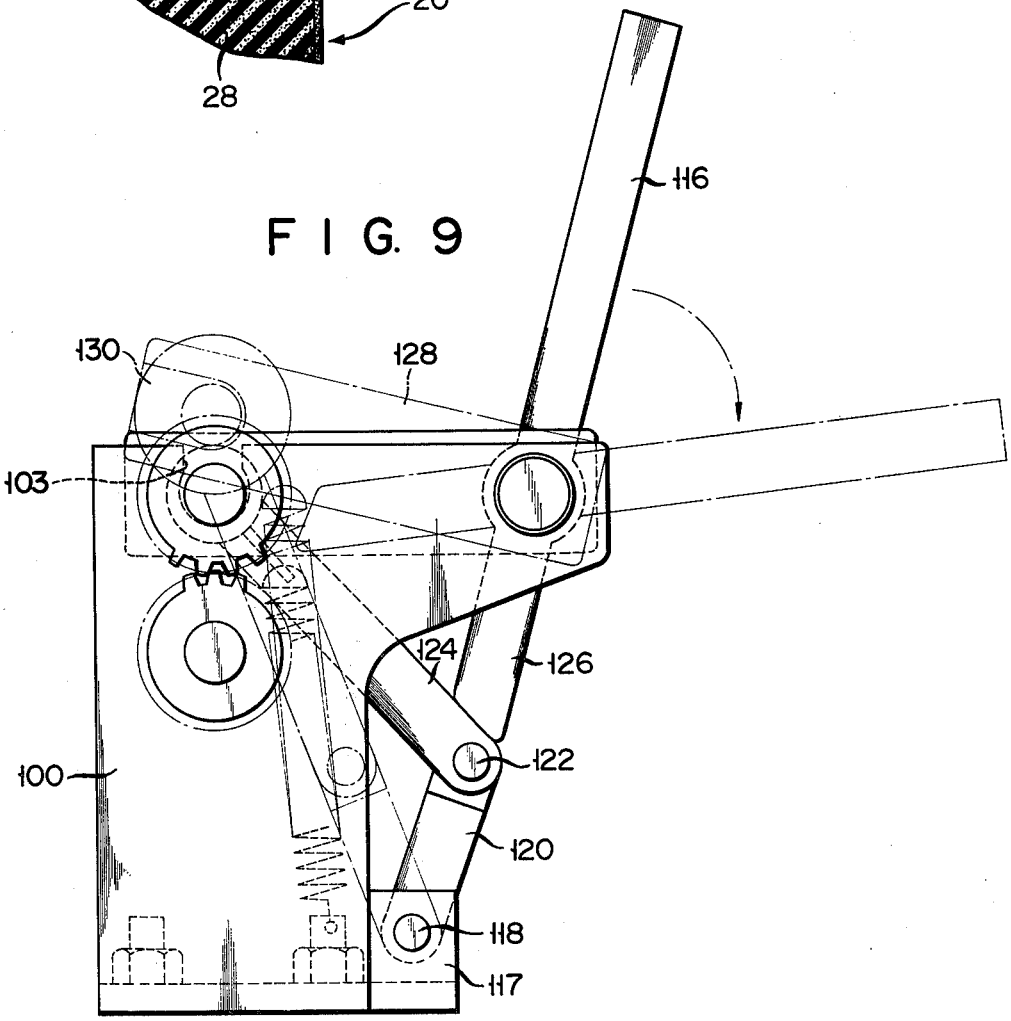
FIG. 9 is a left side elevation of the same.
Figure 5:
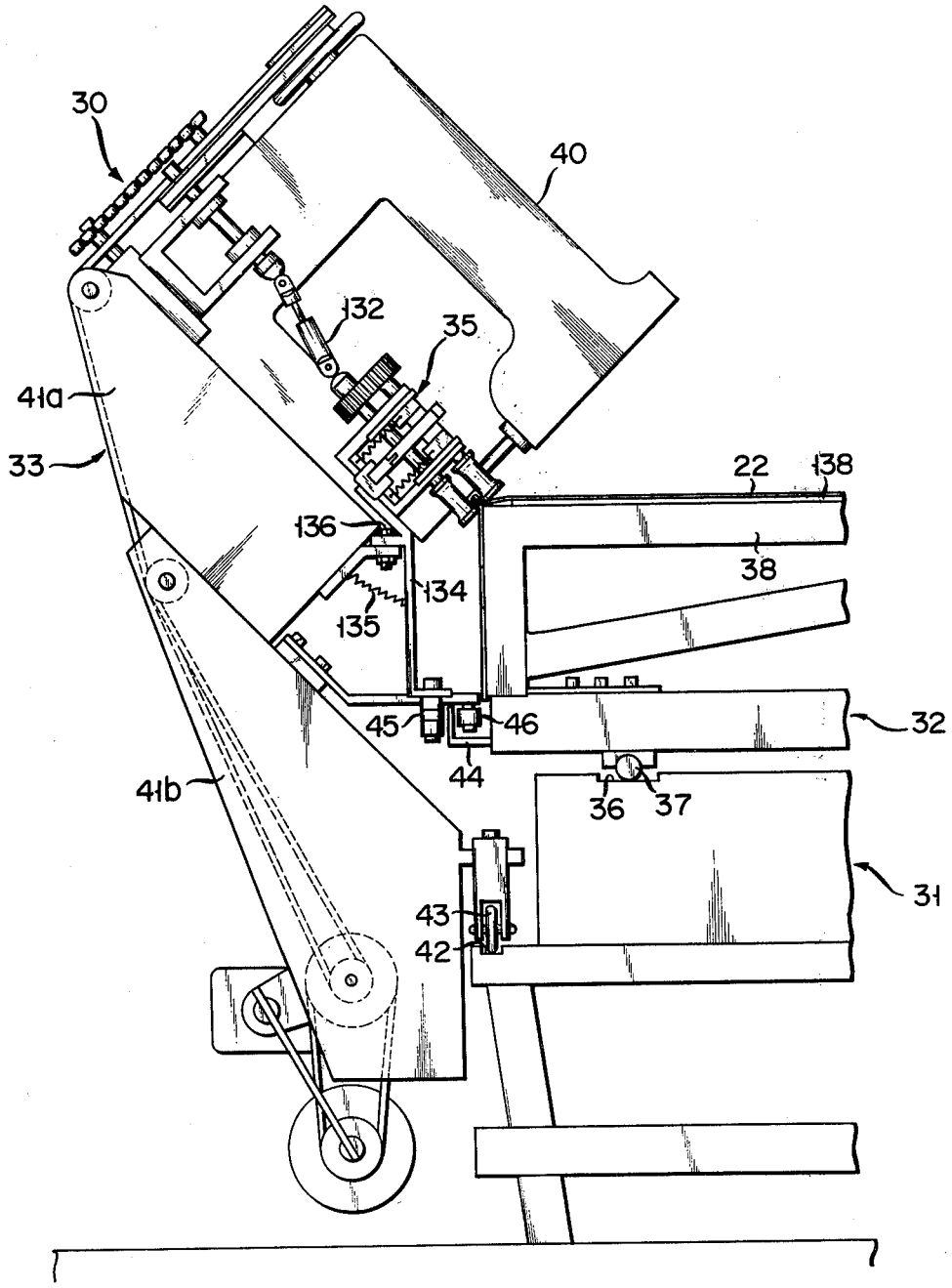
FIG. 5 is a fractional back view of the same.
Figure 8:
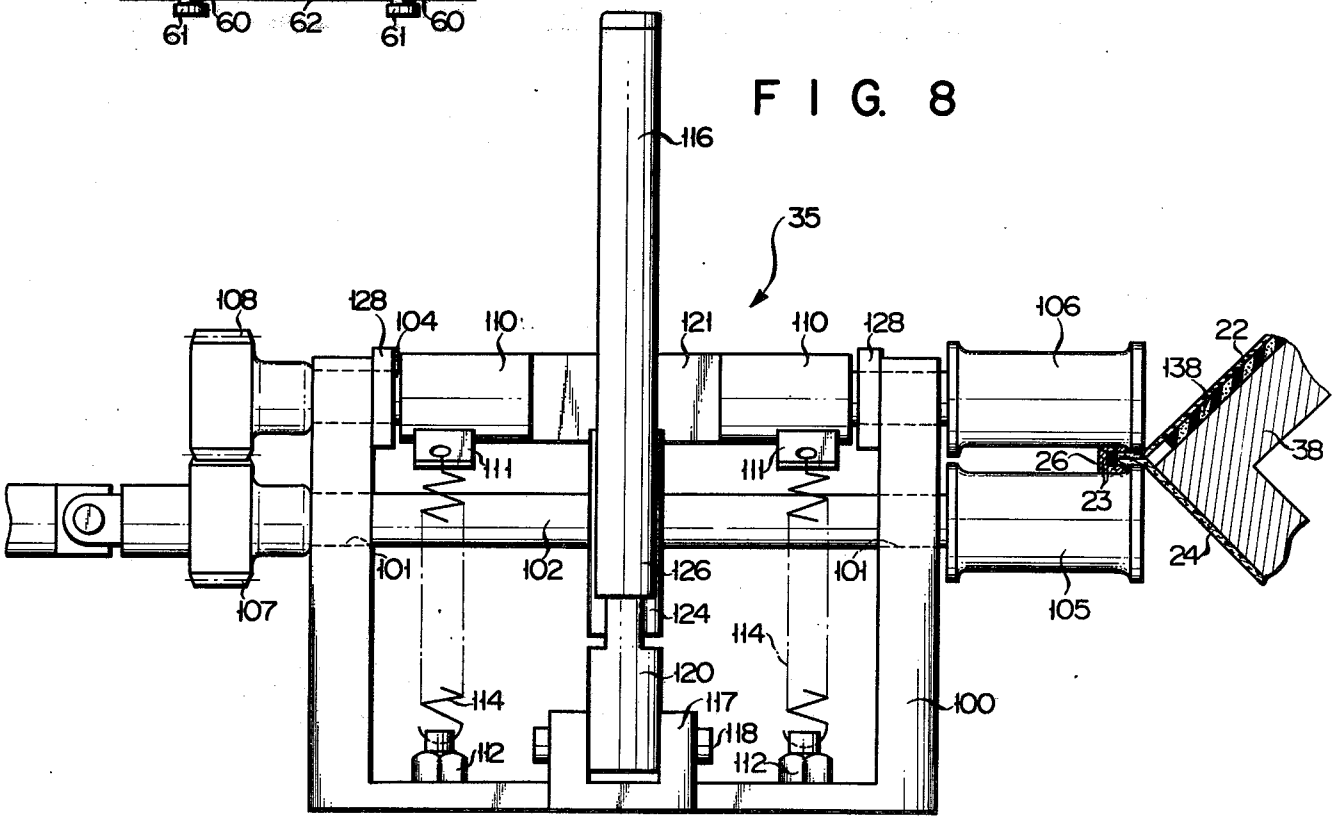
FIG. 8 is a front view of a sewn edge portion-pulling device.

The pulling device 35 is set, as shown in FIG. 5, behind the sewing device 33 to pull the sewn edge portions of the upper and lower sheets 22 and gusset 24 of a cushion cover. As indicated in detail in FIG. 8, the pulling device 35 comprises a shaft 102 movably inserted into round holes 101 bored in a channel-shaped fitting board 100 and a shaft 104 disposed above the first- mentioned shaft 102 and movably inserted into an elongate hole 103 (FIG. 9). The shaft 104 is designed to move through the elongate hole 103 in the opposite direction to the first-mentioned shaft 102. The shafts 102, 104 are provided at one end with horizontal rollers 105, 106 respectively and at the other end with spur gears 107, 108 respectively. The sewn edge portions of the upper and lower sheets 22 and gusset 24 of a cushion cover are clamped, as shown in FIG. 8, between the horizontal rollers 105, 106. A pair of spaced sleeves 110 are loosely fitted around the movable shaft 104. The sleeves 110 are each provided with a flange 111. A pair of tension coil springs 114 are stretched between bolt nuts 112 for fixing the channel-shaped fitting board 100 to the upper carrier section 41a and the flanges 111 to pull the movable shaft 104 toward the fixed shaft 102. The pulling device 35 further comprises a toggle 116 designed to broaden a space between the horizontal rollers 105, 106 by causing the movable shaft 104 to be shifted through the elongate hole 103 for the insertion of the sewn edge portions of the upper and lower sheets 22 and gusset 24 of a cushion cover into the space or the removal of the edge portions therefrom. The toggle 116 comprises a first link 120 connected by a pivot pin 118 to a channel-shaped frame 117 fixed to the channel-shaped fitting board 100, and a second link 124, one end of which is fixed to a central sleeve 121 loosely fitted to the movable shaft 104 between the spaced sleeves 110, and the other end of which is connected to the other end of the first link 120 by a pivot pin 122. The central sleeve 121 may be integrally formed with the spaced sleeves 110. Where a rotatable lever 126 one end of which abuts against the second link 124 is rotated, then the first and second links 120, 124 are linearly set against the biasing force of the tension coil springs 114. Accordingly, the movable shaft 104 is pushed upward through the elongate hole 103, thereby providing a required space between the horizontal rollers 105, 106. Support boards 128 are fitted to the movable shaft 104 between the spaced sleeves 110 and the inner walls of the channel-shaped fitting board 100. The support boards 128 are bored with elongate holes 130 (FIG. 9) into which the movable shaft 104 is loosely fitted. Even when withdrawn from the elongate holes 103 of the channel-shaped fitting board 100 and moved upward, the movable shaft 104 is still held in the elongate holes 130 of the support boards 128. The fixed shaft 102 is supplied with a driving power from a power source, as shown in FIG. 5, through a universal joint 132. As the result, the movable shaft 104 is also supplied with a driving power through engagement between gear wheels 107, 108 (FIG. 8), thereby rotating the horizontal rollers 105, 106 simultaneously.

As seen from FIG. 5, the input side of the universal joint 132 is fitted to the upper carrier section **41*a*. The pulling device 35 lying on the output side of the universal joint 132 is fixed to a fitting arm 134. This fitting arm 134 is attached to the upper carrier section 41*a* to be rendered slightly movable, and is normally urged toward the bag holder 38 by a compression coil spring 135. Since the channel-shaped fitting board 100 is shifted together with the fitting arm 134 by the biasing force of the compression coil spring 135, the universal joint 132** should be constructed further to have an expansible property. This object is attained by assembling a pair of shafts each having a semicircular end portion so as to cause said semicircular end portions to be pressed against each other.

There will now be described the operation of a fabric-sewing machine embodying this invention which is arranged as described above. The core materials 23 previously sewn to the edge portions of the upper and lower sheets 22 and gusset 24 of a cushion cover which are placed on the upper and side walls of the bag holder 38 respectively are first inserted into a space between the clamping members 54 and central projecting board 50 by rotating the handle 68 of the core material guiding mechanism 34. Where the handle 68 is later rotated again to release a cam action, the core materials 23 are firmly held between the clamping members 54 and central projecting board 50. The edge portions of the upper and lower sheets 22 and gusset 24 which are automatically engaged with each other due to the core materials 23 being clamped by the core material-guiding mechanism 34 are carried to the sewing device 33. During the operation of a sewing needle, the clamping members 54 reciprocate by a driving power transmitted through coupling means. As the result, the core materials 23 are clamped by the core material-guiding mechanism 34 by being guided along the guide surface 59 of the projecting guide attachments 58. The edge portions of the upper and lower sheets 22 and gusset 24 of a cushion cover sewn together in a state covered with a cloth tape 26 are brought into a space between the horizontal rollers 105, 106 whose width was previously controlled by the action of the toggle 116. Where the rotatable lever 126 is brought back to the original position after insertion of the engaged edge portions, the tension coil springs 114 pull the movable shaft 104 toward the fixed shaft 102, thereby causing the engaged edge portions to be clamped firmly and elastically between the horizontal rollers 105, 106. While the sewing needle is operated, the horizontal rollers 105, 106 are rotated by a driving power transmitted through the universal joint 132 to push the intervening engaged edge portions away from the sewing machine, thereby imparting a prescribed elastic pulling force or tension to the engaged edge portions now lying in the sewing position.

After the edge portion-guiding section is thus set, the engaged edge portions are automatically sewn together. At this time the reciprocating clamping members 54 of the core material-guiding mechanism 34 impart a pulling force to the upper and lower sheets 22 and gusset 24 of a cushion cover which are going to be clamped, possible giving rise to the formation of creases or folds. This event acts to obstruct the smooth insertion of the engaged edge portions between the clamping members 54. To avoid such difficulty, it is preferred to provide a buffer material, for example , polyurethane foam 138 (FIG. 4) between the bag holder 38 and the upper and lower sheets 22 of a cushion cover. The polyurethane foam 138 subjects the upper and lower sheets 22 to a proper degree of friction and absorbs by its own compressibility the pulling force applied to the sheets by the reciprocating clamping members 54, thereby preventing the formation of creases or folds on the upper and lower sheets 22 and gusset 24. Further, the positions in which the engaged edge portions of the upper and lower sheets 22 and gusset 24 of a cushion cover are clamped by the core material-guiding mechanism 34, sewn together by the sewing device 33 and pulled by the pulling device 35 are linearly spaced from each other at a prescribed distance. At the corners of a cushionn cover, therefore, the engaged edge portions thereof undergo a force which tends to displace said edge portions from the core material-guiding mechanism 34. However, the edge portions are firmly held between the clamping members 54 and the fixed central projecting board 50 by the biasing force of the compression coil springs 60, and moreover the guide arm 70 (FIG. 6) extends into the gusset 24 for engagement, thereby fully preventing the engaged edge portions of a cushion cover from being thrown out of the core material-guiding mechanism 34. Actually, however, the pully device 35 is slightly shifted along the bolt 136 (FIG. 5) by the above-mentioned edge portion-displacing force. But the universal joint 132 is designed, as previously described, further to have an expansible property, thereby suppressing the occurrence of difficulties in the rotation of the horizontal rollers 105, 106.

Where a microswitch, for example, is actuated just before a cushion cover is sewn up substantially throughout all the edge portions. the operation of the sewing machine is automatically stopped. At this time, the lever 68 of the core material-guiding mechanism 34 is rotated to release said mechanism 34 from a clamping position. Thereafter, the wing bolt 98 (FIG. 4) is loosened to cause the housing 52 to be rotated along the elongate arcuate hole 96, thereby removing the core materials 23 of the sewn edged portions of a cushion cover from the clamping members 54. The final sewing is carried out by the sewing machine 33 to finish a cushion cover.

Where a cushion 28 is received in a partly sewn bag body open on one side and another or upper sheet of a cushion cover is sewn to the gusset 24. It is advised to remove the bag holder 38 and place a semifinished mattress 20 on the movable table 32. In this case, the cushion 28 of the mattress 20 performs the same action as the polyurethane foam 138, making it unnecessary particularly to provide the polyurethane foam 138.

As mentioned above, a fabric-sewing machine embodying this invention makes it unnecessary manually to engage the edge portions of the upper and lower sheets and gusset of, for example, a cushion cover and carries out substantially automatic sewing, except for the operations of setting the edge portion-guiding section, undertaking the finishing sewing and removing a finished mattress from the sewing machine, thereby enabling mattresses of uniform quality to be manufactured in quantities without demanding an operator to have a great skill. Further advantages of the present fabric-sewing machine are that a single operator can attend to a plurality of sewing machines at the same time due to the advanced automation thereof, thus attaining prominent saving of labor.

I claim:

1. A fabric-sewing machine comprising a core material-guiding mechanism for clamping cord-like elastic core materials previously sewn to the edge portions of two or more fabric pieces, thereby engaging the edge portions; and a sewing device disposed behind the core material-guiding mechanism to sew together the engaged edge portions of fabric pieces; the core material-guiding mechanism comprising:

a housing provided with a central horizontally projecting board, clamping means including a pair of clamping members extending through and out of the housing and provided with a pair of mutually facing projecting guide attachments for guiding the core materials, thereby clamping the core materials between the clamping members and the central horizontally projecting board, coupling means connected to the clamping members so as to effect reciprocation of the clamping members through the housing by converting a rotation moment supplied from a power source into a reciprocation moment, biasing means for biasing the paired clamping members toward the central projecting board, and cam means having a larger diameter sectional and smaller diameter section, the cam means being disposed between the paired clamping members for engagement with the paired clamping members to separate the paired clamping members from each other against the biasing force of the biasing means when the larger diameter section of the cam means is pressed against the paired clamping members, thereby permitting the insertion of the core materials into the clamping means and the removal of the same therefrom.

2. The fabric-sewing machine according to claim 2, wherein the core material-guiding mechanism further comprises lock means for setting the housing in the prescribed position.

3. The fabric-sewing machine according to claim 2, wherein the coupling means of the core material-guiding mechanism comprises a pair of arms movably connected to the paired clamping members by pivot pins, and the lock means of the core material-guiding mechanism comprises a fixed board disposed below the housing and having an elongate arcuate hole therein, said arcuate hole having a radius of curvature substantially equal to that which is centered at the pivot pin of the arm of the coupling means, a fitting member provided with internal threads and fixed to the inner wall of the housing, and a wing bolt threadedly inserted into the internal threads of the fitting member through the elongate arcuate hole from below the fixed board.

4. The fabric-sewing machine according to claim 3, wherein the core material-guiding mechanism further comprises guide means for guiding the insertion of the core materials before being mutually engaged into the core material-guiding mechanism.

5. The fabric-sewing machine according to claim 4, wherein the guide means of the core material-guiding mechanism further comprises a guide arm fixed at one end to the other wall of the housing to extend obliquely downward and being insertable between fabric pieces for engagement with the edge portions thereof.

6. The fabric-sewing machine according to claim 1, which further comprises a pulling device disposed behind the sewing device and provided with a pair of horizontal rollers for pulling the sewn edge portions of fabric pieces by simultaneously rotating while clamping the sewn edge portions.

7. The fabric-sewing machine according to claim 6, wherein the pulling device comprises :

a pair of shafts provided at one end with the paired horizontal rollers and at the other end with mutually engageable gear wheels, a fitting member having round holes therein for movably supporting on one of the paired shafts and also having elongate holes therein for supporting the other of the paired shafts so as to cause it to be moved away from said one shaft, a pair of sleeves loosely fitted about said other shaft and movable away from said one shaft, and a pair of biasing mean stretched between the corresponding sleeves and the fitting member to bias said other movable shaft toward said one shaft.

8. The fabric-sewing machine according to claim 7, wherein the pulling device further comprises toggle means which includes a pair of links fitted at one end to one of the paired sleeves and fitting member and connected together at the other end by a common pivot pin, to cause said other shaft to slide through the elongate hole when the common pivot pin is shifted. wherein the polyethylene cord cord material has a substantially circular cross section.

9. The fabric-sewing machine according to claim 1, wherein the core material is a plastic material.

10. The fabric-sewing machine according to claim 9, wherein the core aterial is formed of a polyethylene cord.

11. The fabric-sewing machine according to claim 10,

* * * * *